US010156143B2

(12) United States Patent
Fisk

(10) Patent No.: US 10,156,143 B2
(45) Date of Patent: Dec. 18, 2018

(54) GAS TURBINE ENGINES AND RELATED SYSTEMS INVOLVING AIR-COOLED VANES

(75) Inventor: Benjamin T. Fisk, East Granby, CT (US)

(73) Assignee: United Technologies Corporation, Farmington, CT (US)

( * ) Notice: Subject to any disclaimer, the term of this patent is extended or adjusted under 35 U.S.C. 154(b) by 2041 days.

(21) Appl. No.: 11/951,573

(22) Filed: Dec. 6, 2007

(65) Prior Publication Data

US 2009/0148269 A1 Jun. 11, 2009

(51) Int. Cl.
*F01D 5/18* (2006.01)

(52) U.S. Cl.
CPC ..... *F01D 5/187* (2013.01)

(58) Field of Classification Search
CPC ... F01D 5/14; F01D 5/147; F01D 5/18; F05D 2240/301; F05D 2240/306
USPC ..... 415/115, 193; 416/96 R, 97 R, 232, 233
See application file for complete search history.

(56) References Cited

U.S. PATENT DOCUMENTS 2,489,683 A * 11/1949 Stalker ..... 60/726
2,647,368 A 8/1953 Heinrich Triebbnigg et al.
2,956,773 A * 10/1960 French ..... 416/90 R
3,742,706 A * 7/1973 Klompas ..... 60/726
3,844,678 A * 10/1974 Sterman et al. ..... 416/97 R
4,135,855 A * 1/1979 Peill ..... 416/90 R
4,297,077 A * 10/1981 Durgin et al. ..... 416/97 R
4,312,624 A * 1/1982 Steinbauer et al. ..... 415/115
4,767,261 A * 8/1988 Godfrey et al. ..... 415/115
5,193,980 A * 3/1993 Kaincz et al. ..... 416/97 R
5,215,431 A * 6/1993 Derrien ..... 415/115
5,281,084 A * 1/1994 Noe et al. ..... 415/115
5,288,207 A 2/1994 Linask
5,328,331 A 7/1994 Bunker et al.
5,511,309 A 4/1996 Beabout
5,603,606 A * 2/1997 Glezer ..... F01D 5/187 415/115
5,626,462 A 5/1997 Jackson et al.
(Continued)

FOREIGN PATENT DOCUMENTS

DE 892698 10/1953
EP 1022432 7/2000
(Continued)

OTHER PUBLICATIONS

Extended European Search Report dated Feb. 20, 2012.

*Primary Examiner* — Igor Kershteyn
*Assistant Examiner* — Theodore Ribadeneyra
(74) *Attorney, Agent, or Firm* — Carlson, Gaskey & Olds, P.C.

(57) ABSTRACT

Gas turbine engines and related systems involving air-cooled vanes are provided. In this regard, a representative vane for a gas turbine engine includes: an airfoil having a leading edge, a pressure surface, a trailing edge and a suction surface; and a cooling air channel; the suction surface being formed by an exterior surface of a first wall portion and an exterior surface of a second wall portion, the first wall portion spanning a length of the suction surface between the second wall portion and the trailing edge; the cooling air channel being defined, at least in part, by an interior surface of the first wall portion, the first wall portion exhibiting a thickness that is thinner than a thickness exhibited by the second wall portion.

21 Claims, 2 Drawing Sheets

(56) References Cited

U.S. PATENT DOCUMENTS

| | | | | | |
|---|---|---|---|---|---|
| 5,669,759 | A | | 9/1997 | Beabout | |
| 5,690,472 | A | * | 11/1997 | Lee | 416/97 R |
| 5,702,232 | A | * | 12/1997 | Moore | 416/95 |
| 5,716,192 | A | * | 2/1998 | Phillips et al. | 415/115 |
| 5,813,835 | A | | 9/1998 | Corsmeier et al. | |
| 5,813,836 | A | * | 9/1998 | Starkweather | 416/97 R |
| 5,820,337 | A | * | 10/1998 | Jackson et al. | 415/200 |
| 5,931,636 | A | * | 8/1999 | Savage et al. | 415/115 |
| 6,004,100 | A | * | 12/1999 | Przirembel et al. | 416/97 R |
| 6,254,334 | B1 | | 7/2001 | LaFleur | |
| 6,419,449 | B2 | * | 7/2002 | Ferber | 416/96 A |
| 6,481,966 | B2 | | 11/2002 | Beeck et al. | |
| 6,605,364 | B1 | * | 8/2003 | Conner et al. | 428/469 |
| 6,974,308 | B2 | | 12/2005 | Halfmann et al. | |
| 7,090,461 | B2 | | 8/2006 | Liang | |
| 7,093,335 | B2 | * | 8/2006 | Conner et al. | 29/402.01 |
| 7,097,417 | B2 | | 8/2006 | Liang | |
| 7,131,818 | B2 | * | 11/2006 | Cunha et al. | 416/97 R |
| 7,179,047 | B2 | * | 2/2007 | Cooper | 415/115 |
| 7,241,113 | B2 | * | 7/2007 | MacManus | 416/90 R |
| 7,478,994 | B2 | * | 1/2009 | Cunha et al. | 416/97 R |
| 7,513,739 | B2 | * | 4/2009 | Boury et al. | 415/115 |

FOREIGN PATENT DOCUMENTS

| | | | | | |
|---|---|---|---|---|---|
| EP | 1101900 | | 5/2001 | | |
| EP | 1288438 | | 3/2003 | | |
| EP | 1790819 | | 5/2007 | | |
| GB | 778672 | | 7/1957 | | |
| GB | 1530256 | | 10/1978 | | |
| GB | 2408076 | | 5/2005 | | |
| WO | WO 2007122022 | A1 * | 11/2007 | | F01D 5/14 |

* cited by examiner

GAS TURBINE ENGINES AND RELATED SYSTEMS INVOLVING AIR-COOLED VANES

STATEMENT REGARDING FEDERALLY SPONSORED RESEARCH AND DEVELOPMENT

The U.S. Government may have an interest in the subject matter of this disclosure as provided for by the terms of contract number N00421-99-C-1270 awarded by the United States Navy.

BACKGROUND

Technical Field

The disclosure generally relates to gas turbine engines.

Description of the Related Art

As gas turbine engine technology has advanced to provide ever-improving performance, various components of gas turbine engines are being exposed to increased temperatures. Oftentimes, the temperatures exceed the melting points of the materials used to form the components.

In order to prevent such components (e.g., vanes of turbine sections) from melting, cooling air typically is directed to those components. For instance, many turbine vanes incorporate film-cooling holes. These holes are used for routing cooling air from the interior of the vanes to the exterior surfaces of the vanes for forming thin films of air as thermal barriers around the vanes.

SUMMARY

Gas turbine engines and related systems involving air-cooled vanes are provided. In this regard, an exemplary embodiment of a vane for a gas turbine engine comprises: an airfoil having a leading edge, a pressure surface, a trailing edge and a suction surface; and a cooling air channel; the suction surface being formed by an exterior surface of a first wall portion and an exterior surface of a second wall portion, the first wall portion spanning a length of the suction surface between the second wall portion and the trailing edge; the cooling air channel being defined, at least in part, by an interior surface of the first wall portion, the first wall portion exhibiting a thickness that is thinner than a thickness exhibited by the second wall portion.

An exemplary embodiment of a turbine section for a gas turbine engine comprises: a turbine stage having stationary vanes and rotatable blades; a first of the vanes having a cooling air channel and an airfoil with a leading edge, a pressure surface, a trailing edge and a suction surface; the suction surface being formed by an exterior surface of a first wall portion and an exterior surface of a second wall portion, the first wall portion spanning a length of the suction surface between the second wall portion and the trailing edge; the cooling air channel being defined, at least in part, by an interior surface of the first wall portion, the first wall portion exhibiting a thickness that is thinner than a thickness exhibited by the second wall portion.

An exemplary embodiment of a gas turbine engine comprises: a compressor section; a combustion section located downstream of the compressor section; and a turbine section located downstream of the combustion section and having vanes; a first of the vanes having a cooling air channel and an airfoil with a leading edge, a pressure surface, a trailing edge and a suction surface; the suction surface being formed by an exterior surface of a first wall portion and an exterior surface of a second wall portion, the first wall portion spanning a length of the suction surface between the second wall portion and the trailing edge; the cooling air channel being defined, at least in part, by an interior surface of the first wall portion, the first wall portion exhibiting a thickness that is thinner than a thickness exhibited by the second wall portion.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

As will be described in detail here, gas turbine engines and related systems involving air-cooled vanes are provided. In this regard, several exemplary embodiments will be described that generally involve the use of cooling channels within the vanes for directing cooling air. In some embodiments, the vanes incorporate thin-walled suction surfaces that do not include film-cooling holes. As used herein, the term "thin-walled" refers to a structure that has a thickness of less than approximately 0.030" (0.762 mm).

Figure 1:
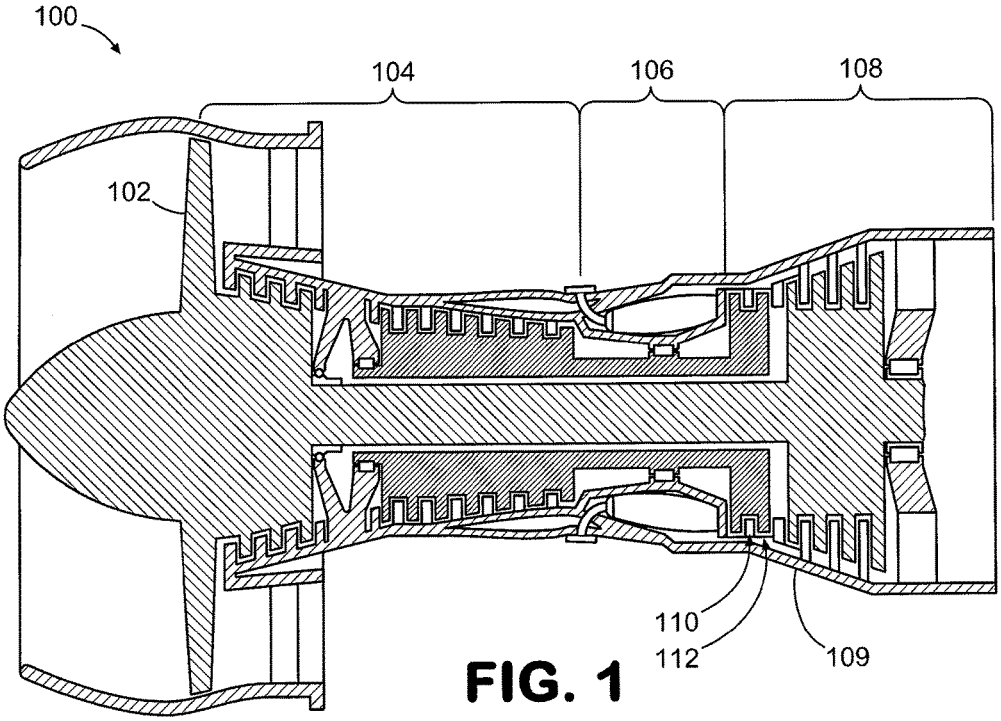
FIG. 1 is a schematic cross-sectional view of an embodiment of a gas turbine engine.

Referring now to the drawings, FIG. 1 is a schematic diagram depicting an exemplary embodiment of a gas turbine engine 100. Although engine 100 is configured as a turbofan, there is no intention to limit the concepts described herein to use with turbofans as use with other types of gas turbine engines is contemplated.

As shown in FIG. 1, engine 100 incorporates a fan 102, a compressor section 104, a combustion section 106 and a turbine section 108. Notably, turbine section 108 is encased by a casing 109, and includes alternating rows of vanes (e.g., vane 110) that are arranged in an annular assembly, and rotating blades (e.g., blade 112). Note also that due to the location of the blades and vanes downstream of the combustion section, the blades and vanes are exposed to high temperature conditions during operation.

Figure 2:
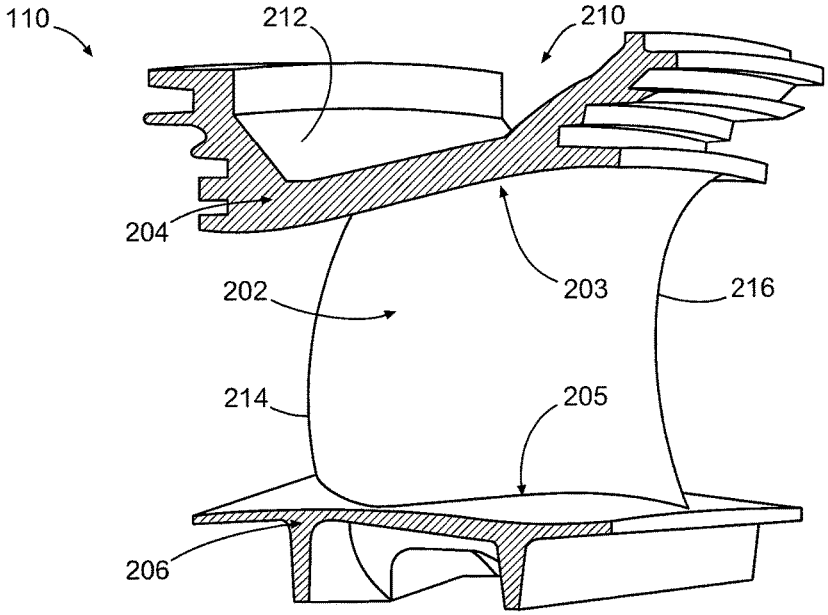
FIG. 2 is a schematic view of an embodiment of a turbine vane.

An exemplary embodiment of a vane is depicted schematically in FIG. 2. As shown in FIG. 2, vane 110 incorporates an airfoil 202, an outer platform 204 and an inner platform 206. A tip 203 of the airfoil is located adjacent outer platform 204, which attaches the vane to casing 109 (FIG. 1). A root 205 of the airfoil is located adjacent inner platform 206, which is used to securely position the airfoil across the turbine gas flow path.

In order to cool the airfoil and platforms during use, cooling air is directed toward the vane. Typically, the cooling air is bleed air vented from an upstream compressor (e.g., a compressor of compressor section 104 of FIG. 1). In the embodiment depicted in FIG. 2, cooling air is generally directed through a cooling air plenum 210 defined by the non-gas flow path structure 212 of the outer platform and static components around the vane. From the cooling air plenum, cooling air is directed through the interior of the airfoil. From the interior of the airfoil, the cooling air is passed to secondary cooling systems and/or vented to the turbine gas flow path located about the exterior of the vane. In some embodiments, this can involve venting cooling air through cooling holes that interconnect the interior and exterior of the vane. Typically, the cooling holes are located along the leading edge 214 and/or trailing edge 216 of the airfoil although various other additional or alternative locations can be used. In the embodiment of FIG. 2, however, such cooling holes are not provided.

Figure 3:
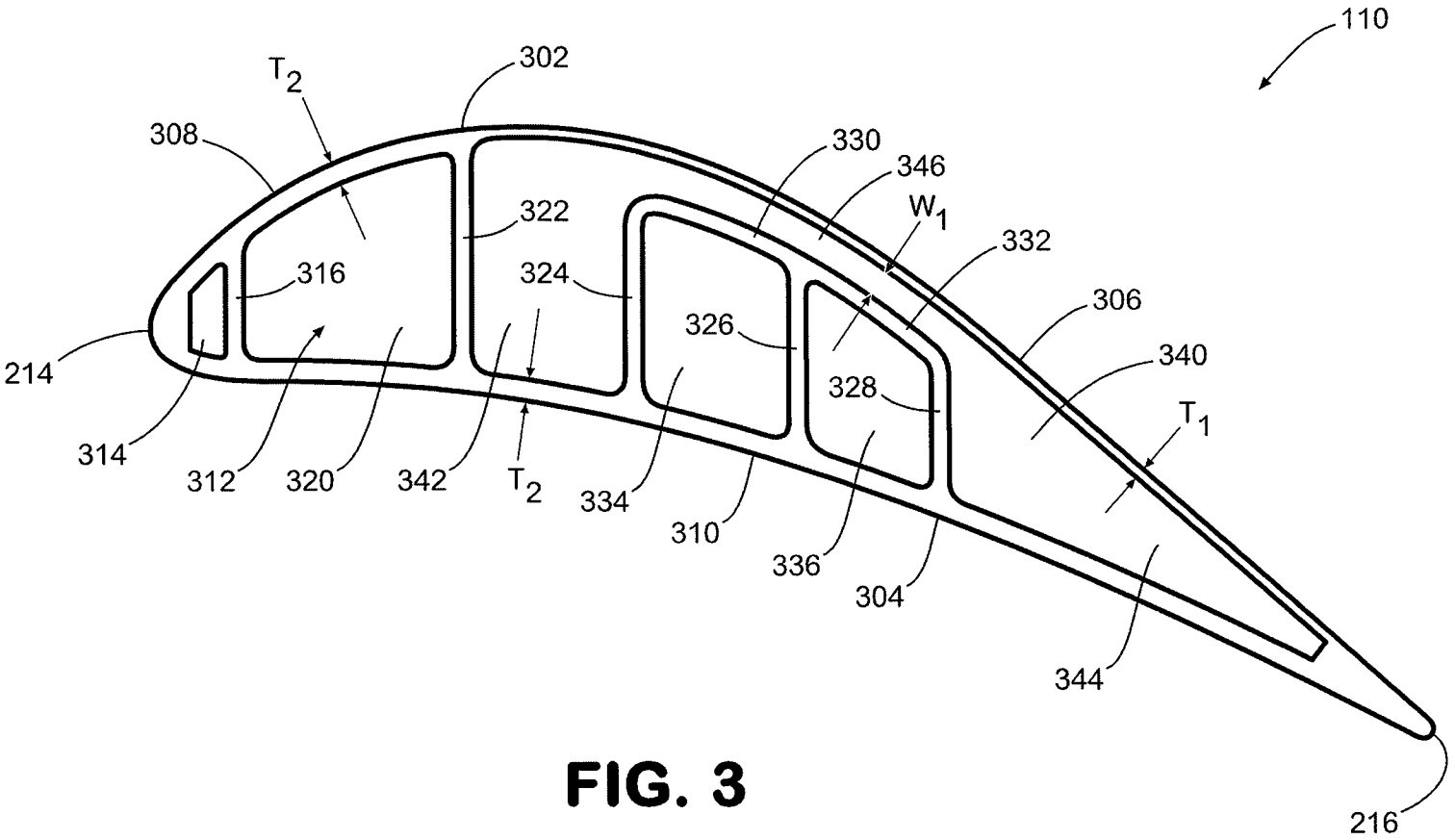
FIG. 3 is a cross-sectional view of the turbine vane of FIG. 2.

In this regard, FIG. 3 is a cross-section of vane 110 of FIGS. 1 and 2. It should be noted that although FIG. 3 is a single cross-section taken at an intermediate location along the length of the airfoil, cross-sections of other locations between the root and the tip of the airfoil are similar in configuration in this embodiment.

As shown in FIG. 3, vane 110 includes leading edge 214, a suction side 302, trailing edge 216, and a pressure side 304. The suction side is defined by exterior surfaces of a first wall portion 306 and a second wall portion 308, whereas the pressure side is formed by the exterior surface of a pressure wall 310. Notably, the first wall portion exhibits a thickness (T.sub.1) of between approximately 0.020" (0.508 mm) and approximately 0.040" (1.016 mm), preferably between approximately 0.030" (0.762 mm) and approximately 0.040" (1.016 mm), and a length of between approximately 0.400" (10.16 mm) and approximately 0.800" (20.32 mm), preferably between approximately 0.500" (12.7 mm) and approximately 0.600" (15.24 mm). A ratio of the thickness between the length of the first wall thickness and the first wall length is between 0.25 to 0.1. In contrast, the second wall portion and pressure side each exhibits a thickness (T.sub.2) of between approximately 0.035" (0.889 mm) and approximately 0.060" (1.524 mm), preferably between approximately 0.045" (1.143 mm) and approximately 0.055" (1.397 mm). Whereby the ratio between the thickness of the second section and the first section is between 1.75 to 1.5.

An interior 312 of the airfoil includes multiple cavities and passageways. Specifically, a cavity 314 is located between second wall portion 308 and the pressure wall 310 that extends from the leading edge 214 to a rib 316. As used herein, a rib is a supporting structure that extends between the pressure side and the suction side of the airfoil. As seen in FIG. 3. the first wall portion 306 has no ribs attaching to any midpoint thereof. Furthermore, as seen in FIG. 3, there are no connectors extending across the intermediate portion 346 of the cooling air channel.

A cavity 320 is located between the second wall portion 308 and the pressure wall 310 that extends from rib 316 to a rib 322. In contrast to the ribs, multiple partial ribs are provided that extend generally parallel to the ribs from the pressure side but which do not extend entirely across the airfoil to the suction side. In this embodiment, partial ribs 324, 326, and 328 are provided. The partial ribs engage wall segments 330 and 332 to form passageways 334 and 336. Specifically, passageway 334 is defined by pressure wall 310, partial ribs 324, 326 and wall segment 330, and passageway 336 is defined by pressure wall 310, partial ribs 326, 328 and wall segment 332. The passageways can be used to route cooling air through the vane and to other portions of the engine.

A cooling air channel 340 is located adjacent to the first wall portion of the suction side. In this embodiment, a forward portion 342 of the cooling air channel extends between the suction side and the pressure side. Similarly, an aft portion 344 of the cooling air channel extends between the suction side and the pressure side. In contrast, an intermediate portion 346 of the cooling air channel extends between the suction side and the wall segments 330, 332. Thus, the cooling air channel surrounds passageways 334, 336 except for those portions of the passageways that are located adjacent to the pressure side of the airfoil. In the embodiment of FIG. 3, a width (W.sub.1) of intermediate portion 346 of the cooling air channel between the suction side and the wall segments is between approximately 0.080" (0.432 mm) and approximately 0.100" (2.54 mm), preferably between approximately 0.060" (1.524 mm) and approximately 0.120" (3.048 mm). As shown in FIG. 3, there are no impediments between the intermediate portion 346 and the forward portion 342 and between the intermediate portion 346 and the aft portion 344. The wall segments 330 and 332 are detached from the pressure wall 310 as seen in FIG. 3.

In operation, cooling air is provided to the cooling air channel 340 in order to cool the suction side of the airfoil. Since the material forming the first wall portion of the suction side is thin, the flow of cooling air can be adequate for preventing the first wall portion from melting during use. This can be accomplished, in some embodiments, without provisioning at least the first wall portion of the suction side with film-cooling holes. Notably, providing of cooling air to the cooling air channel can be in addition to or instead of routing cooling air through the passageways 334, 336.

A combination of dimensional designs, manufacturing techniques, and materials used allow various thin-walled configurations to be created. For example, with respect to cooling air channel 340, the relatively large cross-sectional areas of portions 342 and 344 create stiffness within the core body used to produce cooling air channel 340. Notably, an exemplary manufacturing technique for forming internally cooled turbine airfoils utilizes the loss-wax manufacturing process, in which internal cavities (such as cooling air channel 340) are created with a core body. In this regard, dimensional control of the component manufactured using a core body depends, at least in part, upon the ability to manufacture the core body into a cavity shape with sufficient stiffness and strength. Creating the large cross-sectional areas of portions 342 and 344 allows for this stiffness and strength.

To control the location and thin-walled aspect of wall thickness of first wall portion 306 and wall segments 330, 332, core standoff features (not shown) are added to the core body in some embodiments to prevent warping, sagging and/or drifting of the core material during casting of the alloy.

It should be noted that in some embodiments, an airfoil can be sufficiently cooled without the use of suction side cooling holes. Eliminating the cooling holes (which is done in some embodiments) provides multiple potential benefits such as reduction in machining time and associated costs in install cooling holes in the airfoil. Additionally, the cooling air required during operation of such cooling holes requires more air to be diverted from the core flow of the gas turbine engine, which can directly affect engine performance.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, although a specific number of ribs and passageways are described, various other numbers and arrangements of the constituent components of a vane can be used in other embodiments. All such modifications and variations are intended to be included herein within the scope of this disclosure and protected by the accompanying claims.

The invention claimed is:

1. A vane for a gas turbine engine comprising:

an airfoil having a leading edge, a pressure wall having an interior pressure wall surface and an exterior pressure wall surface, a trailing edge and a suction wall having an interior suction wall surface and an exterior suction wall surface;

a cooling air channel;

the exterior suction wall surface being formed by an exterior surface of a first wall portion and an exterior surface of a second wall portion, the first wall portion spanning a length of the suction wall between the second wall portion and the trailing edge;

the cooling air channel being defined, at least in part, by an interior surface of the first wall portion, the first wall portion exhibiting a thickness that is thinner than a thickness exhibited by the second wall portion, a rib extending between the interior suction wall surface and the interior pressure wall surface;

a cooling air passage, the cooling air passage being isolated from the cooling air channel, at least in part, by a wall segment disposed between the interior pressure wall surface and the interior suction wall surface, the wall segment being spaced from the interior surface of the first wall portion and spaced from the interior pressure wall surface, wherein there are no direct connections between the first wall portion and the wall segment, wherein the wall segment is supported between the pressure wall and the suction wall by at least one partial rib, and wherein the wall segment is closer to the interior suction side surface than the interior pressure side surface.

2. The vane of claim 1, wherein the thickness of the first wall portion is between approximately 0.020 inches (0.508 millimeters)' and approximately 0.040 inches (1.016 millimeters)'.

3. The vane of claim 2, wherein the thickness of the first wall portion is between approximately 0.030 inches (0.762 millimeters)' and approximately 0.040 inches (1.016 millimeters)'.

4. The vane of claim 1, wherein the first wall portion lacks cooling holes communicating between the exterior surface and the cooling air channel.

5. The vane of claim 1, wherein the second wall portion extends between the leading edge and the rib.

6. The vane of claim 1, wherein: the airfoil extends between a root and a tip; and the airfoil exhibits a uniform cross-section from a vicinity of the root to a vicinity of the tip.

7. The vane of claim 1, wherein: the pressure surface is formed by the exterior surface of a pressure wall; and the vane further comprises a partial rib extending between an interior surface of the pressure wall and the wall segment such that the partial rib divides the passage into a first passageway and a second passageway.

8. The vane of claim 1, further comprising: a first platform attached to a root of the airfoil; and a second platform attached to a tip of the airfoil.

9. The vane of claim 1, wherein said at least one partial rib is connected at a first end to said wall segment and at a second end to an interior surface of said pressure surface.

10. The vane of claim 1, wherein the pressure wall has a uniform thickness from the leading edge to the trailing edge.

11. A turbine section for a gas turbine engine comprising:

a turbine stage having stationary vanes and rotatable blades;

a first of the vanes having a cooling air channel and an airfoil with a leading edge, a pressure wall having an interior pressure wall surface and an exterior pressure wall surface, a trailing edge and a suction wall having an interior suction wall surface and an exterior suction wall surface;

the exterior suction wall surface being formed by an exterior surface of a first wall portion and an exterior surface of a second wall portion, the first wall portion spanning a length of the suction wall between the second wall portion and the trailing edge;

the cooling air channel being defined, at least in part, by an interior surface of the first wall portion, the first wall portion exhibiting a thickness that is thinner than a thickness exhibited by the second wall portion, a rib extending between the interior suction wall surface and the interior pressure wall surface;

the first wall portion extends between the trailing edge and the rib;

a cooling air passage, the cooling air passage being isolated from the cooling air channel, at least in part, by a wall segment disposed between the interior pressure wall surface and the interior suction wall surface, the wall segment being spaced from the interior surface of the first wall portion and spaced from the interior pressure wall surface, wherein there are no there are no connectors extending across the cooling air passage between the first wall portion and the wall segment, wherein the wall segment is supported between the pressure wall and the suction wall by at least one partial rib, and wherein the wall segment is closer to the interior suction side surface than the interior pressure side surface.

12. The turbine of claim 11, wherein: the first of the vanes is associated with a second stage vane assembly; and the turbine further comprises a first stage vane assembly located upstream of the second stage vane assembly.

13. The vane of claim 11, wherein the turbine is a high-pressure turbine.

14. The vane of claim 11 wherein there are no connectors extending across an intermediate portion of the cooling air channel.

15. A gas turbine engine comprising:

a compressor section; a combustion section located downstream of the compressor section;

a turbine section located downstream of the combustion section and having vanes;

a first of the vanes having a cooling air channel and an airfoil with a leading edge, a pressure wall having an interior pressure wall surface and an exterior pressure wall surface, a trailing edge and a suction wall having an interior suction wall surface and an exterior suction wall surface;

the exterior suction wall surface being formed by an exterior surface of a first wall portion and an exterior surface of a second wall portion, the first wall portion spanning a length of the suction surface between the second wall portion and the trailing edge;

the cooling air channel being defined, at least in part, by an interior surface of the first wall portion, the first wall portion exhibiting a thickness that is thinner than a thickness exhibited by the second wall portion, a rib extending between the suction wall and the pressure wall;

the first wall portion extends between the trailing edge and the rib;

a cooling air passage, the cooling air passage being separated from the cooling air channel, at least in part, by a wall segment disposed between the interior pressure wall surface and the interior suction wall surface, the wall segment being spaced from the interior surface of the first wall portion and spaced from the interior pressure wall surface, wherein there are no direct connections between the first wall portion and the wall segment, wherein the wall segment is supported between the pressure surface and the suction surface by at least one partial rib, and wherein the wall segment is closer to the interior suction side surface than the interior pressure side surface.

16. The gas turbine engine of claim 15, wherein the first wall portion lacks cooling holes communicating between the exterior surface and the cooling air channel.

17. The gas turbine engine of claim 15, wherein: the first of the vanes is associated with a second stage vane assembly; and the turbine section further comprises a first stage vane assembly located upstream of the second stage vane assembly.

18. The gas turbine engine of claim 15, wherein the airfoil extends between a root and a tip; and the airfoil exhibits a uniform cross-section from a vicinity of the root to a vicinity of the tip.

19. The gas turbine engine of claim 15, wherein the length of the first wall portion from the trailing edge to the second wall portion is between approximately 0.400 inches (10.16 millimeters)' and approximately 0.800 inches (20.32 millimeters)'.

20. A vane for a gas turbine engine comprising:

an airfoil having a leading edge, a pressure wall having an interior pressure wall surface and an exterior pressure wall surface, a trailing edge and a suction wall having an interior suction wall surface and an exterior suction wall surface; and a cooling air channel;

the exterior suction wall surface being formed by an exterior surface of a first wall portion and an exterior surface of a second wall portion, the first wall portion spanning a length of the exterior suction wall surface between the second wall portion and the trailing edge; the cooling air channel being defined, at least in part, by an interior surface of the first wall portion, the first wall portion exhibiting a thickness that is thinner than a thickness exhibited by the second wall portion, a rib extending between the suction wall and the pressure wall;

the first wall portion extends between the trailing edge and the rib; and, a cooling air passage, the cooling air passage being isolated from the cooling air channel, at least in part, by a wall segment disposed between the interior surface of the pressure wall and the interior surface of the suction wall, the wall segment being spaced from the interior surface of the first wall portion and spaced from the interior pressure wall surface, wherein said first wall portion has no ribs attaching to any midpoint thereof, and wherein the wall segment is supported between the pressure surface and the suction surface by at least one partial rib.

21. The vane of claim 1, wherein the cooling air passage is a pass through passage.

* * * * *